US007730873B2

(12) United States Patent
Schoell

(10) Patent No.: US 7,730,873 B2
(45) Date of Patent: Jun. 8, 2010

(54) VALVE CONTROLLED THROTTLE MECHANISM IN A HEAT REGENERATIVE ENGINE

(75) Inventor: Harry Schoell, Pompano Beach, FL (US)

(73) Assignee: Cyclone Power Technologies, Inc., Pompano Beach, FL (US)

( * ) Notice: Subject to any disclaimer, the term of this patent is extended or adjusted under 35 U.S.C. 154(b) by 7 days.

(21) Appl. No.: 11/827,854

(22) Filed: Jul. 13, 2007

(65) Prior Publication Data

US 2007/0256664 A1 Nov. 8, 2007

Related U.S. Application Data

(60) Division of application No. 11/489,335, filed on Jul. 19, 2006, which is a continuation of application No. 11/225,422, filed on Sep. 13, 2005, now Pat. No. 7,080,512.

(60) Provisional application No. 60/609,725, filed on Sep. 14, 2004.

(51) Int. Cl.
*F02M 7/00* (2006.01)

(52) U.S. Cl. ..... 123/344; 91/244

(58) Field of Classification Search ..... 261/18.2; 123/25 P, 321, 90.16, 90.17, 344, 25 D; 91/244, 91/262, 351, 270, 333; 92/12.1, 58, 72, 148, 92/68; *F02M 7/00*

See application file for complete search history.

(56) References Cited

U.S. PATENT DOCUMENTS

| | | | | |
|---|---|---|---|---|
| 313,008 | A * | 2/1885 | Lynn | 92/72 |
| 2,513,982 | A * | 7/1950 | Williams | 91/244 |
| 3,786,792 | A * | 1/1974 | Pelizzoni et al. | 123/321 |
| 5,149,466 | A * | 9/1992 | Megenbier | 261/18.2 |
| 7,324,889 | B2 * | 1/2008 | Arai et al. | 701/103 |

* cited by examiner

*Primary Examiner*—Stephen K Cronin
*Assistant Examiner*—Keith Coleman
(74) *Attorney, Agent, or Firm*—Robert M. Downey, P.A.

(57) ABSTRACT

In an engine having at least one cylinder with a reciprocating piston and a connecting rod for driving rotation of a crank disk and a crankshaft, a cam sleeve is moved along the crankshaft in response to a change in engine speed. The cam sleeve is coupled to a cam ring that moves with the cam sleeve and in a spiraling motion about the longitudinal axis of the crankshaft. A follower engages an outer face of the cam ring and is movable against a pushrod that opens an injector valve. The follower is structured and disposed to move in response to contact with a lobe on the outer face of the cam ring to urge the pushrod against the injector valve. The pushrod passes through a throttle control ring that rotates in an arc. Rotation of the throttle ring, with the use of a control lever, shifts the position of the pushrod on the follower relative to a fulcrum of the follower to control the distance the pushrod is driven by the follower and, thus, the amount the injector valve is opened.

2 Claims, 7 Drawing Sheets

TOP VIEW

BOTTOM VIEW

VALVE CONTROLLED THROTTLE MECHANISM IN A HEAT REGENERATIVE ENGINE

This application is a divisional patent application of U.S. patent application Ser. No. 11/489,335 filed on Jul. 19, 2006 which is a continuation application of U.S. patent application Ser. No. 11/225,422 filed on Sep. 13, 2005 and now issued U.S. Pat. No. 7,080,512 B2 and which claims the benefit of provisional patent application Ser. No. 60/609,725 filed on Sep. 14, 2004.

BACKGROUND OF THE INVENTION

1. Field of the Invention

The present invention is directed to a throttle mechanism in a radial engine and, more particularly, to a valve controlled throttle mechanism in a heat regenerative engine having a radial arrangement of cylinders, pistons and pushrods.

2. Discussion of the Related Art

Environmental concerns have prompted costly, complex technological proposals in engine design. For instance, fuel cell technology provides the benefit of running on clean burning hydrogen. However, the expense and size of fuel cell engines, as well as the cost of creating, storing, and delivering fuel grade hydrogen disproportionately offsets the environmental benefits. As a further example, clean running electric vehicles are limited to very short ranges, and must be regularly recharged by electricity generated from coal, diesel or nuclear fueled power plants. And, while gas turbines are clean, they operate at constant speed. In small sizes, gas turbines are costly to build, run and overhaul. Diesel and gas internal combustion engines are efficient, lightweight and relatively inexpensive to manufacture, but they produce a significant level of pollutants that are hazardous to the environment and the health of the general population and are fuel specific.

The original Rankin Cycle Steam Engine was invented by James Watt over 150 years ago. Present day Rankin Cycle Steam Engines use tubes to carry super heated steam to the engine and, thereafter, to a condenser. The single tubes used to pipe super heated steam to the engine have a significant exposed surface area, which limits pressure and temperature levels. The less desirable lower pressures and temperatures, at which water can easily change state between liquid and gas, requires a complicated control system. While Steam Engines are generally bulky and inefficient, they tend to be environmentally clean. Steam Engines have varied efficiency levels ranging from 5% on older model steam trains to as much as 45% in modern power plants. In contrast, two-stroke internal combustion engines operate at approximately 17% efficiency, while four-stroke internal combustion engines provide efficiency up to approximately 25%. Diesel combustion engines, on the other hand, provide as much as 35% engine efficiency.

OBJECTS AND ADVANTAGES OF THE INVENTION

With the foregoing in mind, it is a primary object of the present invention to provide a throttle control in an engine that is compact and which operates at high efficiency.

It is a further object of the present invention to provide a compact and reliable throttle control mechanism in a highly efficient engine.

It is still a further object of the present invention to provide a throttle mechanism in a highly efficient and compact engine which is environmentally friendly, and which uses external combustion and water lubrication.

It is still a further object of the present invention to provide a throttle mechanism in a compact and highly efficient steam engine which has multi-fuel capacity, allowing the engine to burn any of a variety of fuel sources and combinations thereof.

It is still a further object of the present invention to provide a throttle mechanism in a compact and highly efficient steam engine which requires no transmission.

These and other objects and advantages of the present invention are more readily apparent with reference to the detailed description and accompanying drawings.

SUMMARY OF THE INVENTION

The present invention is directed to a valve controlled throttle mechanism in a heat regenerative engine having at least one cylinder with a reciprocating piston and a connecting rod for driving rotation of a crank disk and a crankshaft. According to the invention, a cam sleeve is moved along the crankshaft in response to a change in engine speed. The cam sleeve is coupled to a cam ring that moves with the cam sleeve and in a spiraling motion about the longitudinal axis of the crankshaft. A follower engages an outer face of the cam ring and is movable against a pushrod that opens an injector valve for injecting pressurized steam into the cylinder. The follower is structured and disposed to move in response to contact with a lobe on the outer face of the cam ring to urge the pushrod against the injector valve. The pushrod passes through a throttle control ring that rotates in an arc, displacing where the inner end of the pushrod rests on the arm of the follower. Rotation of the throttle ring, with the use of a control lever, shifts the position of the pushrod on the follower relative to a fulcrum of the follower to control the distance the pushrod is driven by the follower and, thus, the amount the injector valve is opened. Accordingly, the rate of steam injection into the cylinder and speed of piston movement through a power stroke is controlled by the throttle mechanism.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
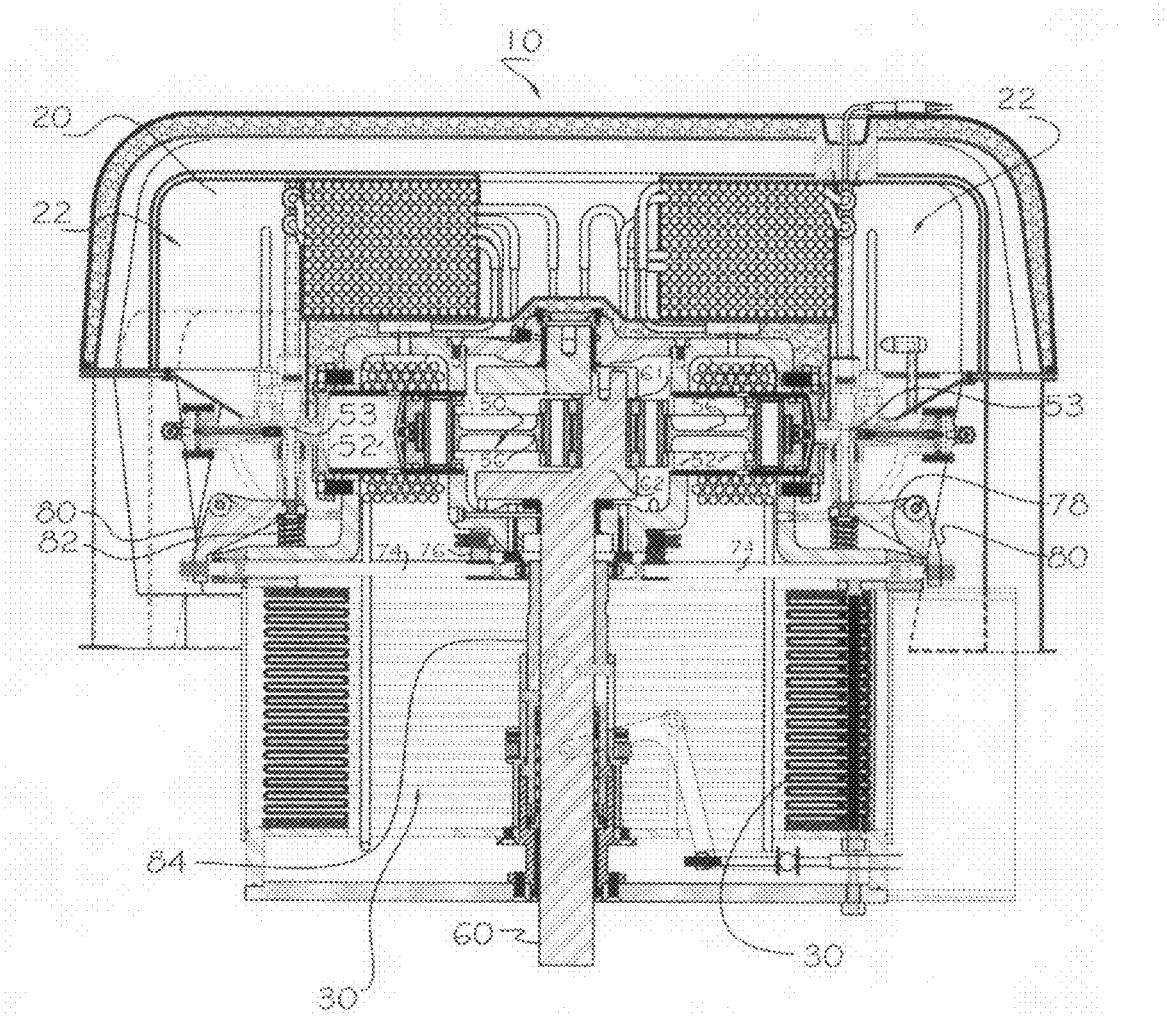
FIG. 1 is a side elevational view, shown in cross-section, illustrating the principal components of the engine.
Figure 2:
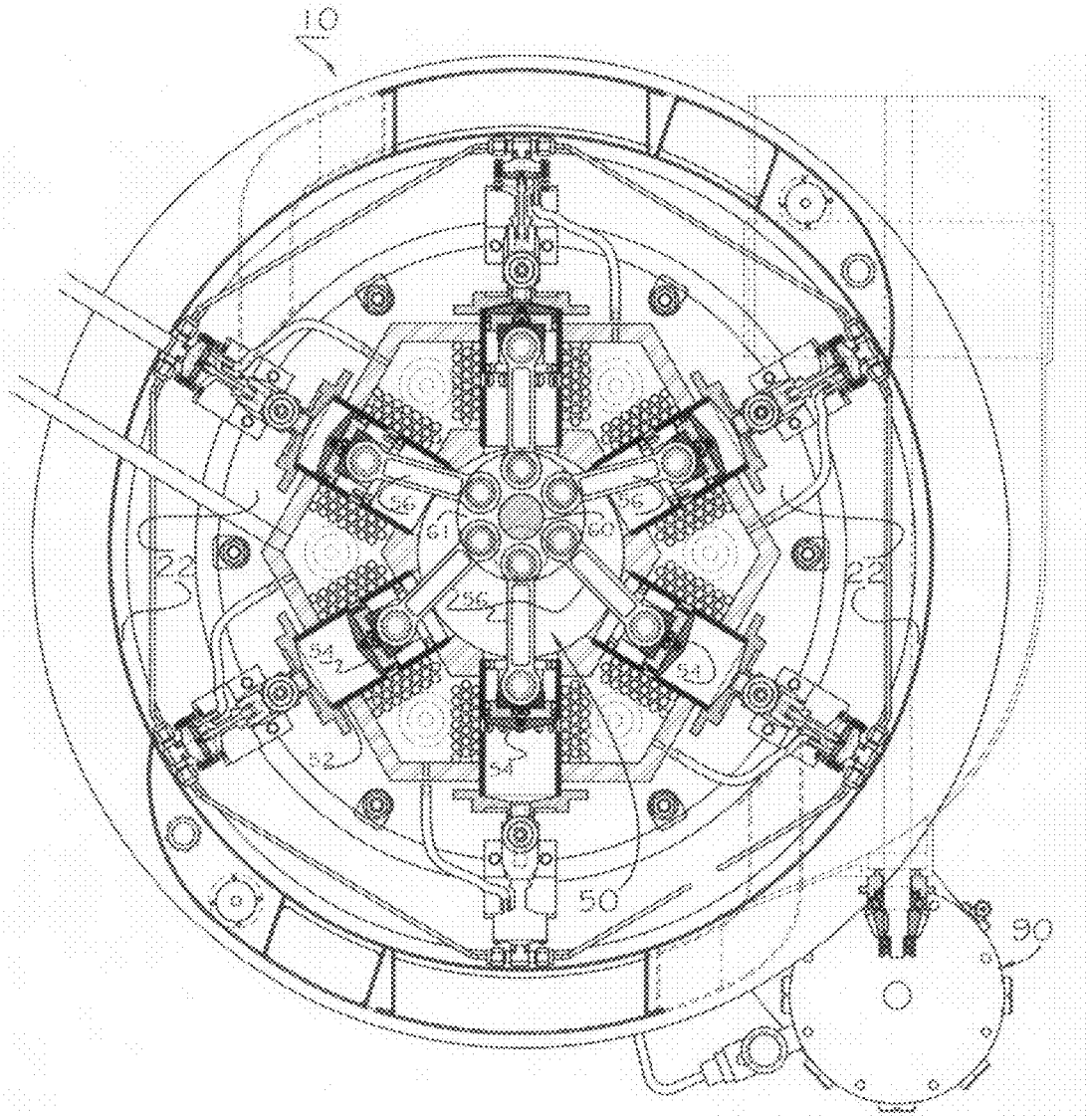
FIG. 2 is a top plan view, in partial cross-section, showing the piston and cylinder arrangement of the engine of FIG. 1.

The present invention is directed to a throttle mechanism in an engine which is generally indicated as 10. Referring initially to FIGS. 1 and 2, an example of engine 10 includes a combustion chamber 22, a condenser 30 and a main engine section comprising cylinders 52, valves 53, pistons 54, push-rods 74, crank cam 61 and a crankshaft 60 extending axially through a center of the engine section.

Figure 3:
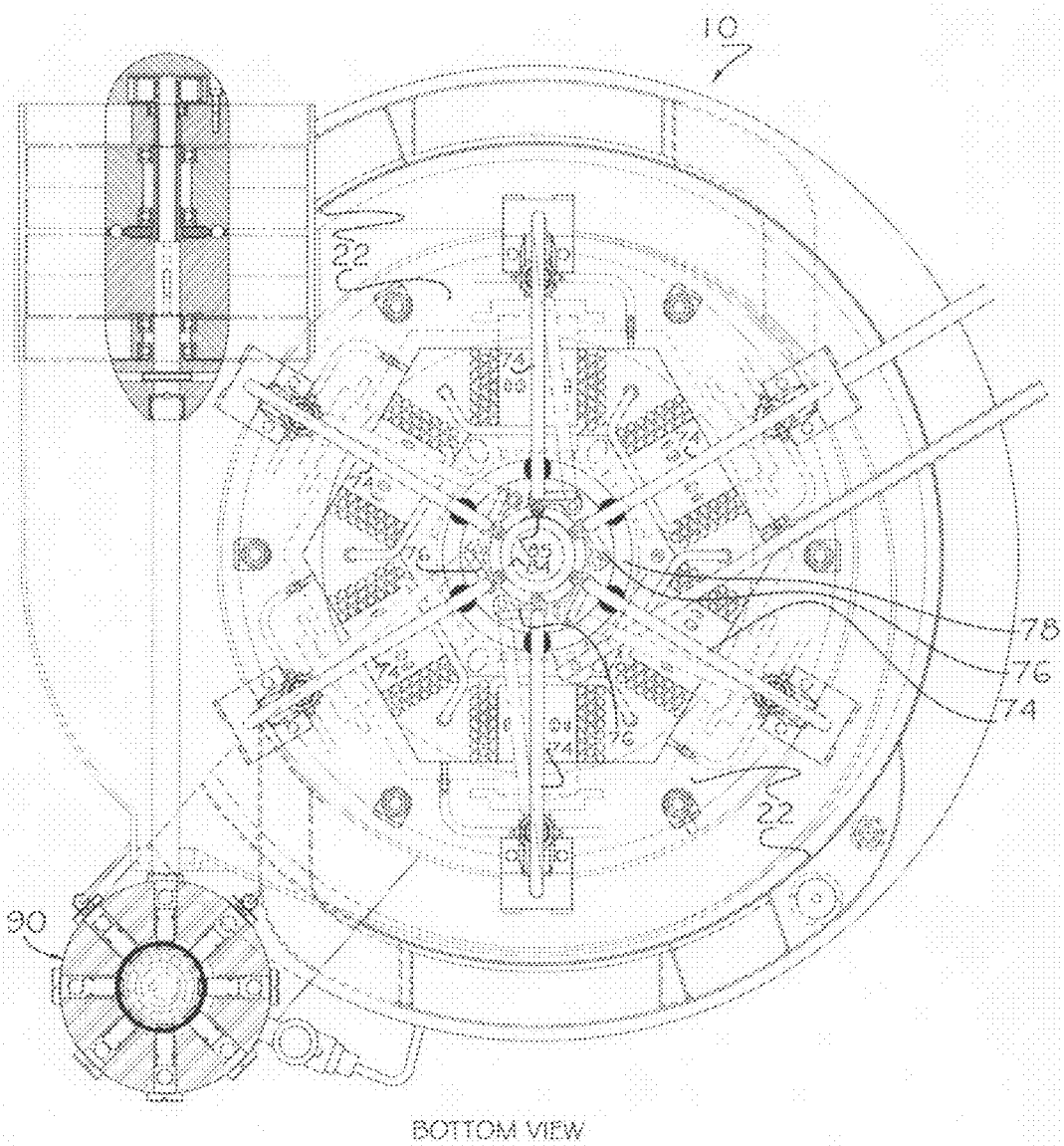
FIG. 3 is a top plan view, in partial cross-section, showing the cam ring, pushrod, and cylinder injector valve arrangement of the engine of FIG. 1.

As best seen in FIGS. 2 and 3, the cylinders 52 of the engine are arranged in a radial configuration with the cylinder heads 51 and valves 53 extending into the cyclone furnace. A cam 84 moves push-rods 74 (see FIGS. 1 and 3) to control opening of steam injection valves 53. At higher engine speeds, the steam injection valves 53 are fully opened to inject steam into the cylinders 52, causing piston heads 54 to be pushed radially inward. Movement of the piston heads 54 causes connecting rods 56 to move radially inward to rotate crank disk 61 and crankshaft 60. Each connecting rod 56 connects to the crank disk 61. More specifically, the inner circular surface of the connecting rod link is fitted with a bearing ring for engagement about a hub on the crank disk 61. The connecting rods 56 are driven by this crank disk 61. The center of the crank disk 61 is yoked to a single crankshaft journal 62 (see FIGS. 5-7) that is offset from the central axis of the crankshaft 60.

Figure 4:
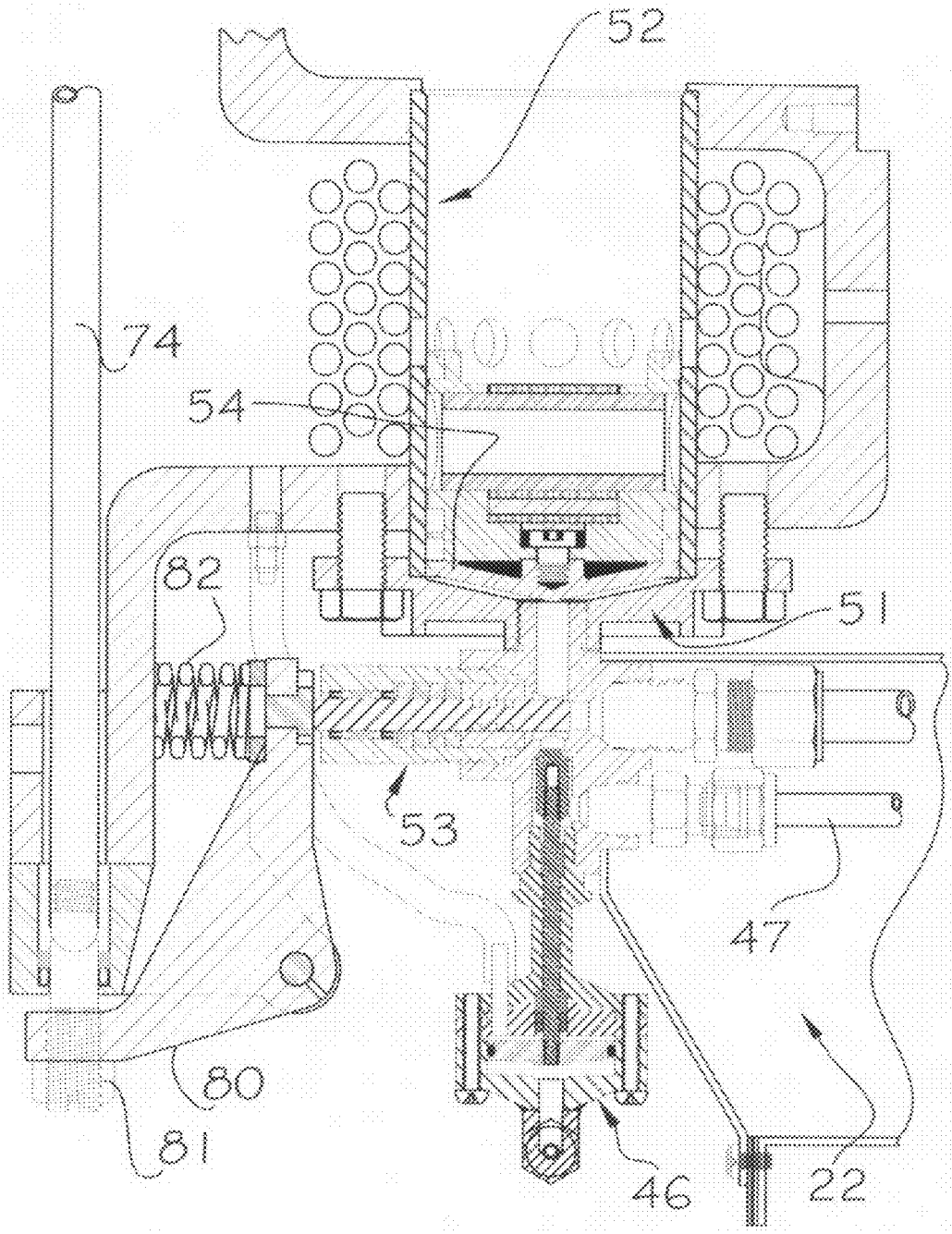
FIG. 4 is an isolated cross-sectional view showing a compression relief valve assembly, injection valve assembly and cylinder head.

Referring to FIG. 4, at lower engine speeds steam injection valves 53 are partially closed and a clearance volume compression release valve 46 is opened to release steam from the cylinders 52. The clearance volume valves 46 are controlled by the engine RPM's. Minimizing the clearance volume in a cylinder 52 is advantageous for efficiency as it lessens the amount of super-heated steam required to fill the volume, reduces the vapor contact area which absorbs heat that would otherwise be used in the explosive expansion of the power stroke, and, by creating higher compression in the smaller chamber, further raises the temperature of the admitted steam. However, the higher compression resulting from the smaller volume has the adverse effect at low engine RPM of creating back pressure against the incoming charge of super-heated steam. The purpose of the clearance volume valve 46 is to reduce the cylinder compression at lower engine RPMs, while maintaining higher compression at faster piston speeds where the back pressure effect is minimal. The clearance volume valve 46 controls the inlet to a tube 47 that extends from the cylinder into the combustion chamber 22. At lower RPM, the clearance volume valve 46 opens the tube 47. By adding the incremental volume of this tube 47 to that of the cylinder 52, the total clearance volume is increased with a consequent lowering of the compression. The vapor charge flowing into the tube is additionally heated by the combustion chamber 22 which surrounds the sealed tube 47, vaporizing back into the cylinder 52 where it contributes to the total vapor expansion of the low speed power stroke. At higher RPM, the pump system of the engine-driven pump 90 that hydraulically actuates the clearance volume valve, develops the pressure to close the clearance volume valve 46 thereby, reducing the total clearance volume, and raising the cylinder compression for efficient higher speed operation of the engine. The clearance volume valves 46 contribute to the efficiency of the engine at both low and high speed operation.

Steam under super-critical pressure is admitted to the cylinders 52 of the engine 10 by a mechanically linked throttle mechanism acting on the steam injection needle valve 53. Along the middle of the valve stems, a series of labyrinth seals, or grooves in the valve stem, in conjunction with packing rings and lower lip seals, create a seal between each valve stem and a bushing within which the valve moves. This seals and separates the coolant flowing past the top of the valve stem and the approximate 3,200 lbs. psi pressure that is encountered at the head and seat of each valve. Removal of this valve 53, as well as adjustment for its seating clearance, can be made by threads machined in the upper body of the valve assembly. The needle valve 53 admitting the super-heated steam is positively closed by a spring 82 within each valve rocker arm 80 that is mounted to the periphery of the engine casing. Each spring 82 exerts enough pressure to keep the valve 53 closed during static conditions.

Referring to FIG. 3, the motion to open each valve is initiated by a crankshaft-mounted cam ring 84. A lobe 85 on the cam ring forces a throttle follower 76 to 'bump' a single pushrod 74 per cylinder 52. Each pushrod 74 extends from near the center of the radially configured six cylinder engine outward to the needle valve rocker 80. The force of the throttle follower 76 on the pushrod 74 overcomes the spring closure pressure and opens the valve 53. Contact between the follower, the rocker arm 80, and the pushrod 74 is determined by a threaded adjustment socket 81 mounted on each needle valve rocker arm 80.

Throttle control on the engine is achieved by varying the distance each pushrod 74 is extended, with further extension opening the needle valve a greater amount to admit more super-heated fluid. All six rods 74 pass through a throttle control ring 78 that rotates in an arc, displacing where the inner end of each pushrod 74 rests on the arm of each cam follower (see FIG. 5). Unless the follower 76 is raised by the cam lobe 85, all positions along the follower where the pushrod 74 rests are equally 'closed'. As the arc of the throttle ring 78 is shifted, the resting point of the pushrod 74 shifts the lever arm further out and away from the fulcrum of the follower. When the follower 76 is bumped by the cam lobe 85, the arc distance that the arm traverses is magnified, thereby driving the pushrod 74 further, and thus opening the needle valve 53 further. A single lever attached to the throttle ring 78 and extending to the outside of the engine casing is used to shift the arc of the throttle ring, and thus becomes the engine throttle.

Figure 5:
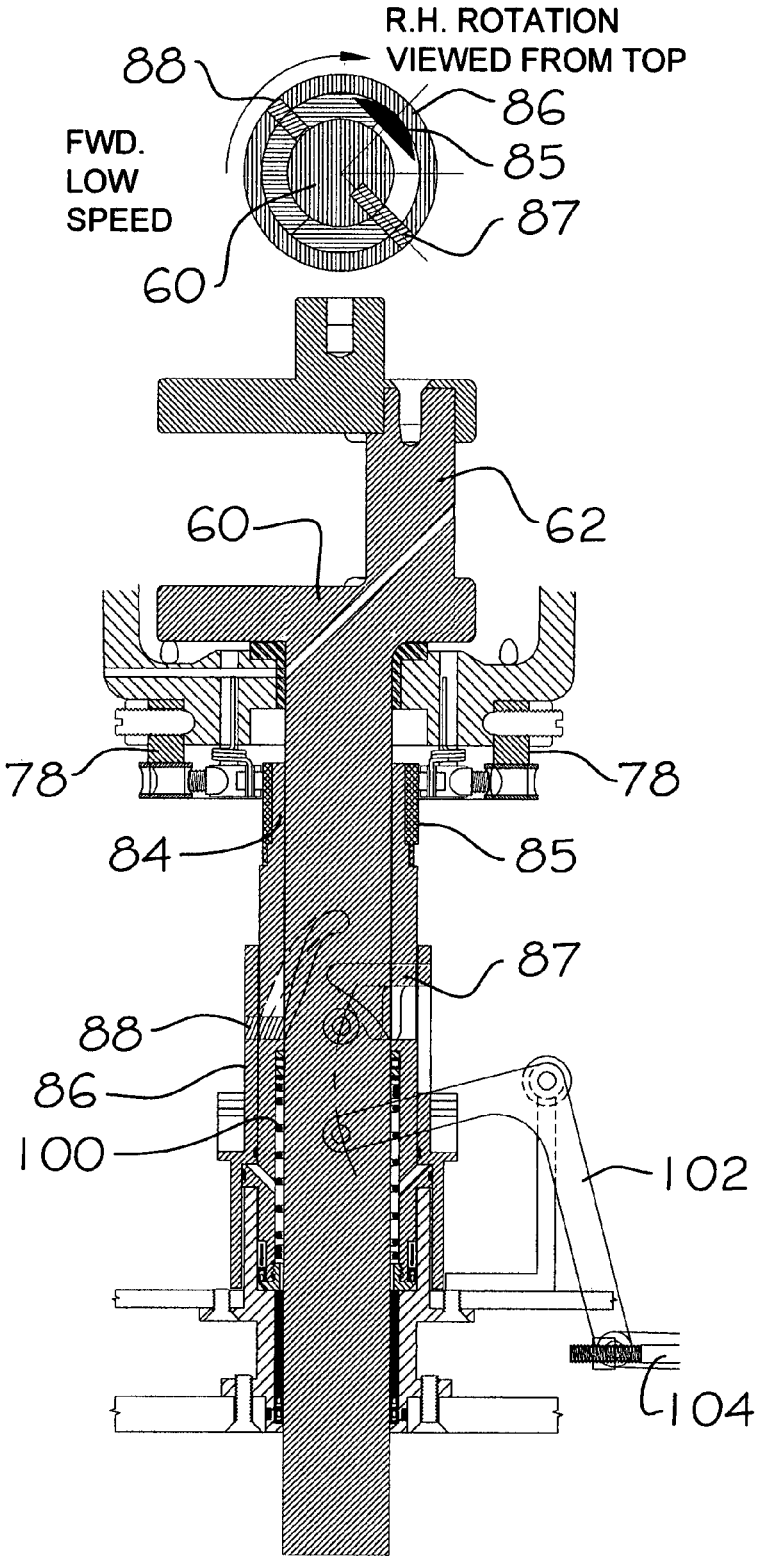
FIG. 5 is a cross-sectional view of a throttle control and engine timing control assembly engaged in a forward direction at low speed.
Figure 6:
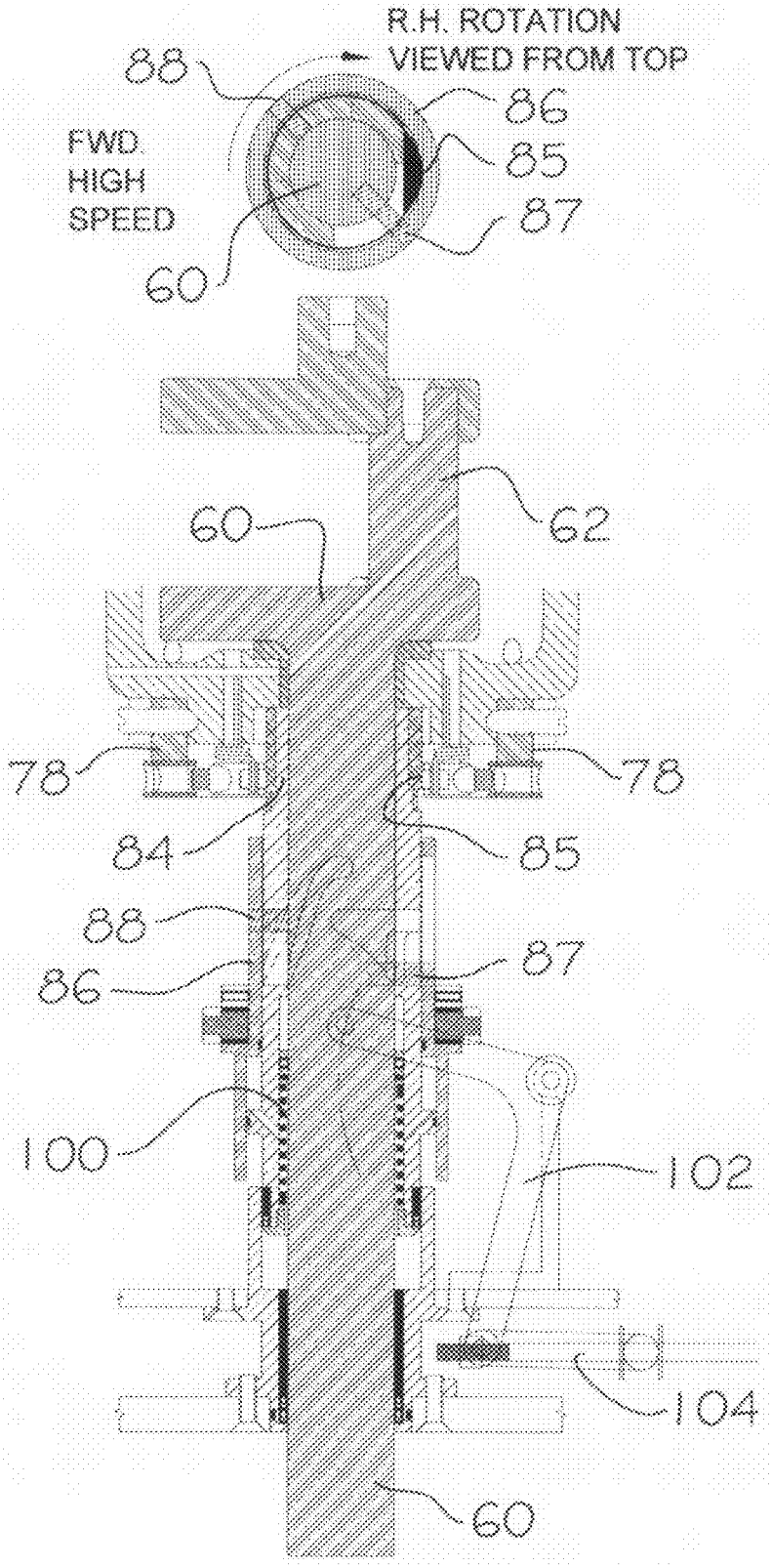
FIG. 6 is a cross-sectional view of the throttle control and engine timing control assembly engaged in a forward direction at high speed.
Figure 7:
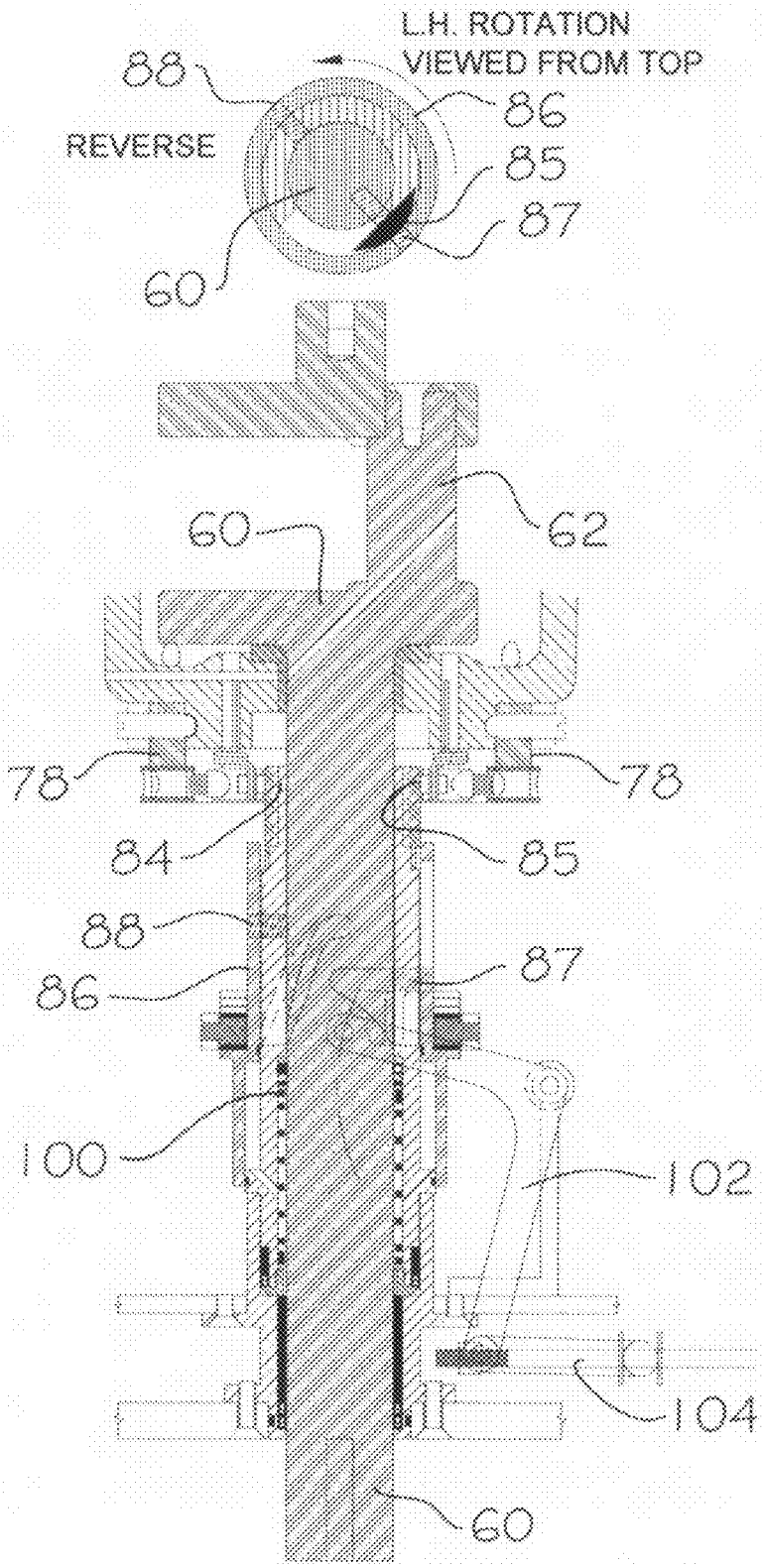
FIG. 7 is a cross-sectional view of the throttle control and engine timing control assembly engaged in a reverse direction.

Referring to FIGS. 5-7, timing control of the engine is achieved by moving the cam ring 84. Timing control advances the moment super-heated fluid is injected into each piston and shortens the duration of this injection as engine RPMs increase. 'Upward' movement of the cam ring 84 towards the crankshaft journal 62 alters the timing duration by exposing the follower 76 to a lower portion of the cam ring 84 where the profile of the lobe 85 of the cam is progressively reduced. Rotating this same cam ring 84 alters the timing of when the cam lobe triggers steam injection to the cylinder(s). Rotation of the cam ring is achieved by a sleeve cam pin 88 that is fixed to the cam sleeve 86. The cam pin 88 extends through a curvilinear vertical slot in the cam ring 84, so that as the cam ring 84 rises, by hydraulic pressure, a twisting action occurs between the cam ring 84 and cam sleeve piston 86 wherein the cam ring 84 and lobe 85 partially rotate. These two movements of the cam ring are actuated by the cam sleeve piston 86 that is sealed to and spins with the crankshaft 60. More specifically, a crankshaft cam pin 87 that is fixed to the crankshaft 60 passes through an opening in the cam ring and a vertical slot on the cam sleeve piston. This allows vertical (i.e. longitudinal) movement of the cam ring 84 and the cam sleeve 86 relative to the crankshaft, but prevents relative rotation between the cam sleeve 86 and crankshaft 60 (due to the vertical slot), so that the cam sleeve 86 spins with the crankshaft. A crankshaft driven water pump system provides hydraulic pressure to extend this cam sleeve piston 86. As engine RPMs increase, the hydraulic pressure rises. This extends the cam sleeve piston 86 and raises the cam ring 84, thereby exposing the higher RPM profiles on the lobe 85 to the cam follower(s) 76. Reduced engine speeds correspondingly reduce the hydraulic pressure on the cam sleeve piston 86, and a sealed coil spring 100 retracts the cam sleeve piston 86 and the cam ring 84 itself.

The normal position for the throttle controller is forward slow speed. As the throttle ring 78 admits steam to the piston, the crank begins to rotate in a slow forward rotation. The long duration of the cam lobe 85 allows for steam admission into the cylinders 52 for a longer period of time. As previously described, the elliptical path of the connecting rods creates a high degree of torque, while the steam admission into the cylinder is for a longer period of time and over a longer lever arm, into the phase of the next cylinder, thereby allowing a self starting movement.

As the throttle ring 78 is advanced, more steam is admitted to the cylinder, allowing an increase in RPM. When the RPM increases, the pump 90 supplies hydraulic pressure to lift the cam ring 84 to high speed forward. The cam ring 84 moves in two phases, jacking up the cam to decrease the cam lobe duration and advance the cam timing. This occurs gradually as the RPM's are increased to a pre-determined position. The shift lever 102 is spring loaded on the shifting rod 104 to allow the sleeve 86 to lift the cam ring 84.

To reverse the engine, it must be stopped by closing the throttle. Reversing the engine is not accomplished by selecting transmission gears, but is done by altering the timing. More specifically, reversing the engine is accomplished by pushing the shift rod 104 to lift the cam sleeve 86 up the crankshaft 60 as the sleeve cam pin 88 travels in a spiraling groove in the cam ring causing the crank to advance the cam past top dead center. The engine will now run in reverse as the piston pushes the crank disk at an angle relative to the crankshaft in the direction of reverse rotation. This shifting movement moves only the timing and not the duration of the cam lobe to valve opening. This will give full torque and self-starting in reverse. High speed is not necessary in reverse.

While the present invention has been shown and described in accordance with a preferred and practical embodiment thereof, it is recognized that departures from the instant disclosure are contemplated within the spirit and scope of the present invention.

What is claimed is:

1. A throttle assembly in an engine comprising:

at least one cylinder;

a piston movably captivated within said cylinder and structured and disposed for sealed, reciprocating movement within said cylinder;

a crankshaft;

a crank disk linked to said crankshaft and rotatable to drivingly rotate said crankshaft;

a connecting rod pivotally connected between said piston and said crank disk;

an injector valve operable between a closed position and an open position to release a pressurized charge of steam into said cylinder to move said piston;

a pushrod having a first end and a second end;

a spring biased rocker arm operatively engaged with said pushrod and said injector valve;

a cam ring movably carried on said crankshaft and including an outer circumferential face;

a lobe bulging outwardly from said cam ring about a portion of said outer circumferential face of said cam ring and said lobe having a varying lobe profile;

a follower operatively contacting said cam ring and said first end of said pushrod, said follower being structured and disposed to move relative to a pivot axis in response to contact with said lobe on said cam ring and to urge said pushrod against said injector valve to momentarily open said injector valve;

said cam ring being structured and disposed to move axially along said crankshaft in response to changes in engine speed for moving said varying lobe profile relative to said follower in order to control duration of momentary opening of said injector valve and thereby duration of said release of the pressurized charge of steam into said cylinder;

said cam ring being further structured and disposed to turn through a range of rotational movement relative to said crankshaft for changing the timing of said momentary opening of said injector valve and thereby changing the timing of said release of the pressurized charge of steam into said cylinder;

a throttle control ring linked to said pushrod with said pushrod extending through said throttle control ring and said throttle control ring being rotatable to move the contact position of said first end of said pushrod against said follower relative to said pivot axis of said follower in order to control movement of said pushrod against said injector valve and thereby controlling an amount that said injector valve is momentarily opened and the amount of the pressurized charge of steam that is released into said cylinder; and a lever operatively linked to said throttle control ring for controlling rotatable movement of said throttle control ring, and said lever being operatively moveable to control the amount that said injector valve is momentarily opened, and thereby controlling speed of movement of said piston, said connecting rod and rotational speed of said crankshaft.

2. A throttle assembly in an engine comprising:

at least one cylinder;

a piston movably captivated within said cylinder and structured and disposed for sealed, reciprocating movement within said cylinder;

a crankshaft;

a crank disk linked to said crankshaft and rotatable to drivingly rotate said crankshaft;

a connecting rod pivotally connected between said piston and said crank disk;

an injector valve operable between a closed position and an open position to release a pressurized charge of steam into said cylinder to move said piston;

a pushrod having a first end and a second end;

a spring biased rocker arm operatively engaged with said pushrod and said injector valve;

a cam ring movably carried on said crankshaft and including an outer circumferential face;

a lobe bulging outwardly from said cam ring about a portion of said outer circumferential face of said cam ring and said lobe having a varying lobe profile;

a follower operatively contacting said cam ring and said first end of said pushrod, said follower being structured and disposed to move relative to a pivot axis in response to contact with said lobe on said cam ring and to urge said pushrod against said injector valve to momentarily open said injector valve;

said cam ring being structured and disposed to move axially along said crankshaft in response to changes in engine speed for moving said varying lobe profile relative to said follower in order to control duration of momentary opening of said injector valve and thereby duration of said release of the pressurized charge of steam into said cylinder;

said cam ring being further structured and disposed to turn through a range of rotational movement relative to said crankshaft for changing the timing of said momentary opening of said injector valve and thereby changing the timing of said release of the pressurized charge of steam into said cylinder;

a throttle control ring linked to said pushrod with said pushrod extending through said throttle control ring and said throttle control ring being moveable to control movement of the contact position of said first end of said pushrod against said follower relative to said pivot axis of said follower in order to control movement of said pushrod against said injector valve and thereby controlling an amount that said injector valve is momentarily opened and the amount of the pressurized charge of steam that is released into said cylinder; and a lever operatively linked to said throttle control ring for controlling movement of said throttle control ring, and said lever being operatively moveable to control the amount that said injector valve is momentarily opened, and thereby controlling speed of movement of said piston, said connecting rod and rotational speed of said crankshaft.

* * * * *